United States Patent [19]

Arikawa

[11] Patent Number: 4,511,875

[45] Date of Patent: Apr. 16, 1985

[54] MICRO-FUSE ASSEMBLY

[75] Inventor: Hiroo Arikawa, Tokyo, Japan

[73] Assignee: S.O.C. Corporation, Tokyo, Japan

[21] Appl. No.: 476,229

[22] Filed: Mar. 17, 1983

[30] Foreign Application Priority Data

Mar. 19, 1982 [JP] Japan ..... 57-37984[U]

[51] Int. Cl.[3] ..... H01H 85/02

[52] U.S. Cl. ..... 337/201; 337/186; 337/231

[58] Field of Search ..... 337/186, 201, 213, 227, 337/231, 232, 234, 238, 241, 246, 248, 260, 262, 255, 261, 263

[56] References Cited

U.S. PATENT DOCUMENTS

| | | | |
|---|---|---|---|
| 1,033,123 | 7/1912 | Schweitzer | 337/186 |
| 3,436,711 | 4/1969 | Borzoni | 337/255 |
| 4,349,805 | 9/1982 | Arikawa | 337/260 |

*Primary Examiner*—Harold Broome

[57] ABSTRACT

An electric micro-fuse comprises a hollow body and a lid therefor. The interior of the fuse body is divided into five sections consisting of two raised plateaus and three recessed sections, wherein the central recess is connected to each end recess through a channel. A fusible element is diagonally stretched between the channels and a lead wire is inserted through each end of the fuse body into the end recesses and are soldered to the respective end of the fusible element. After soldering, the fuse body is covered by the lid and sealed hermetically by a suitable adhesive.

8 Claims, 6 Drawing Figures

MICRO-FUSE ASSEMBLY

FIELD OF THE INVENTION

This invention relates to electric fuses and is particularly related to a micro-fuse of the type which is especially useful in electronic printed circuit boards.

In one aspect, the present invention is concerned with a novel micro-fuse assembly having unique construction and configuration. In another aspect, this invention relates to an improved method of manufacturing such micro-fuses.

BACKGROUND OF THE INVENTION

Micro-fuses are widely used in electronic printed circuits or the so-called printed circuit boards (PCB) in various electrical and electronic equipment. These micro-fuses, which are typically 2.5 mm×8 mm, are presently made by a rather cumbersome procedure. According to the conventional method of manufacturing these fuses, a long, generally cylindrical glass or ceramic tube is first cut to the desired length. A fusible element is then stretched diagonally between the ends of the tube and the ends are prefilled with solder. Lead wires are inserted through a perforation at each end cap and are secured to the inside surface of each respective cap. Thus, when the caps are heated, the solder melts and electrical contact is established between the fusible element and the lead wires which are connected to a power source.

In order to insure electrical insulation, the fuse casing is either coated with an insulative material, usually epoxy resin, or it is covered by a thermal shrink insulating tube.

Micro-fuses made according to such conventional methods have several drawbacks and limitations which are inherent in their structure and the method by which they are fabricated. For example, it is generally recognized that it is not desirable to attach, usually by solder, the lead wires to the outside end of the casing because lead wires attached in this manner cannot withstand the tensile strengths to which they are usually subjected due to industrial requirements. In addition, soldering of the lead wires to the outside casing is difficult or impractical. Accordingly, the preferred practice is to solder the lead wires interiorly of the casing, i.e., to the inside surface of the end caps of the fuse. This, however, requires that the fusible element be first passed through the tube and soldered to the inside of the end caps in order to maintain the fusible element at a fixed length while stretched diagonally through the tube. As a practical matter, however, it is difficult to stretch the fusible element diagonally and retain it at a fixed and invariable length because the proper setting of the fusible element cannot be found in cylindrical tubes with generally circular ends. Also, while it is the general practice to hold the fusible element manually and to keep it taut in the stretched position until the melted solder solidifies, this procedure becomes impractical when the fusible element is to be soldered interiorly of the casing. Consequently, before solidification of the solder melt, the fusible element tends to slacken, hence resulting in unstable electrical characteristics due to variations in the length of the fusible element.

Another drawback of conventional micro-fuses results from inadequate bonding of the end caps to the tube casing. Since the solder usually contains a flux (chiefly made of rosin), after soldering, the bond strength between the end caps and the casing is insufficient and cannot retain the necessary mechanical integrity of the structure.

Also, since the end caps of a conventional micro-fuse with lead wire are exposed, they must be electrically insulated. This protection has been afforded by coating with epoxy resin or providing the casing with a thermal shrink insulating tubing. However, epoxy resin coatings and such protective coverings tend to deteriorate at temperatures of 120° C. to 200° C. and, therefore, the resulting fuse cannot be satisfactorily used under such conditions. Moreover, the usual method of marking the rated current and voltage on the fuse is not practical for such coated or protected fuses, making it necessary to replace such marking with color code or label marks, both of which involve cumbersome procedure.

Coating of the micro-fuse with epoxy resin, and the provision of a protective insulative covering, involves additional, and often time consuming and expensive steps in the manufacture of these fuses. Needless to say that the productivity will therefore be considerably reduced.

With the ever-increasing industrial demand for high speed manufacture of micro-fuses which employ extremely fine and small fusible elements, the conventional method of micro-fuse manufacture offers limited capacity to fullfill this objective. In addition, micro-fuses made by the conventional method often fail to meet the stringent industrial requirements.

Accordingly, it is an object of this invention to provide a micro-fuse which, due to unique construction and configuration of its component parts, can be assembled and manufactured efficiently.

It is a further object of this invention to manufacture such micro-fuses by an improved method which simplifies the manufacturing and production procedures for these fuses.

The foregoing and other objects of the present invention will be more clearly comprehended from the following detailed description of the invention and the accompanying drawings.

SUMMARY OF THE INVENTION

In order to overcome the disadvantages which are inherent in the construction of micro-fuses by the conventional methods, this invention provides a unique micro-fuse and a method for its assembly and fabrication. A micro-fuse made according to the present invention comprises a hollow body and a cover therefor which is heremetically sealed to the fuse body after the fusible element has been stretched and soldered to the lead wires. The inside of the fuse body is divided into five parts consisting of two raised plateaus and three recessed section, i.e., a central recess and two end recessed section. A first channel connects the central recess to one of said end recessed section and a second channel connects the central recess to the recessed section at the other end. A fusible element is diagonally stretched between the channels and a lead wire is inserted through each end wall of the fuse body, extending into the respective end recess where it is soldered to the fusible element.

The foregoing method of fabrication of the micro-fuse of the present invention is carried out with the fuse body open thus lending to simplicity and convenience of assembly and production of these fuses. After soldering the lead wires to the ends of the fusible element, the fuse body is covered and hermetically sealed by a suitable adhesive.

BRIEF DESCRIPTION OF THE DRAWINGS

In the drawings, wherein like reference numerals are employed to designate like parts.

DESCRIPTION OF THE PREFERRED EMBODIMENT OF THE INVENTION

Figure 1:
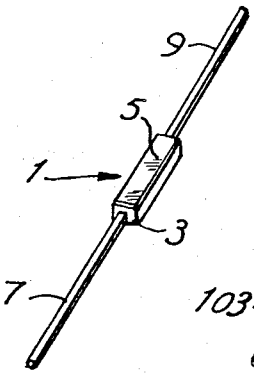
FIG. 1 is a perspective view of a micro-fuse of the present invention.

Referring to FIG. 1, the micro-fuse of the present invention is shown as a rectangular shaped member such as a prism designated as 1 having a body or casing 3 and a lid or cover 5. The body 3 and the lid 5 are both made of highly heat-resistant and insulative material such as glass or ceramic (e.g., steatite). Protruding from the ends of the body 3 are the lead wires 7 and 9 for connection to electrical power source (not shown).

Figure 2:
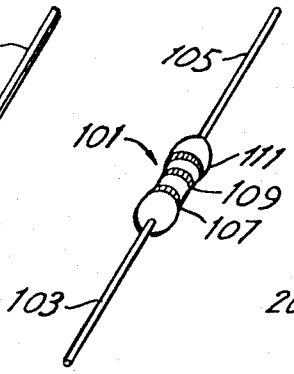
FIG. 2 is a perspective view of a micro-fuse which is made by the conventional method wherein the fuse is protected by epoxy resin coating and provided with color coding.

The fuse shown in FIG. 2 comprises the fuse body 101 and the lead wires 103 and 105. The fuse body 101 is coated with epoxy resin and is color coded as shown at 107, 109 and 111.

Figure 3:
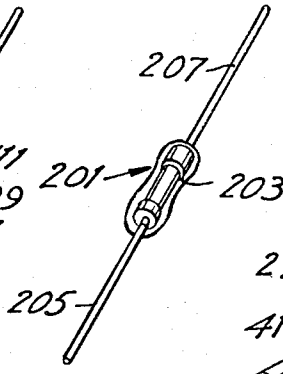
FIG. 3 is a perspective view of a micro-fuse which is also made by the conventional method but wherein the fuse is protected by a thermal shrink insulating tube.

In FIG. 3, the fuse comprises a fuse body 201, a thermal shrink tube 203. The lead wires 205 and 207 protrude from the respective ends of the fuse body 201 as in the fuse of FIG. 2.

Figure 5:
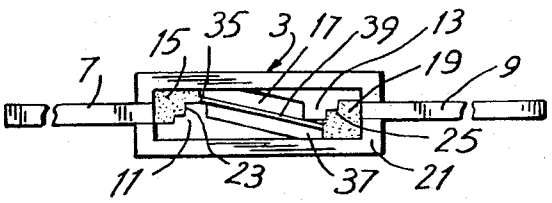
FIG. 5 is a top view of the micro-fuse shown in FIG. 4, with the lid removed, seen in the direction of the arrow A.
Figure 6:
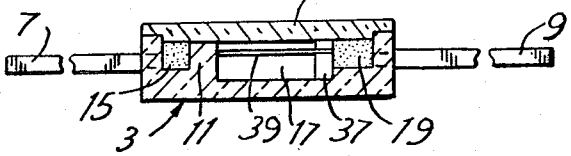
FIG. 6 is a sectional side view of the micro-fuse shown in FIG. 4, seen from the direction of the arrow B.
Figure 4:
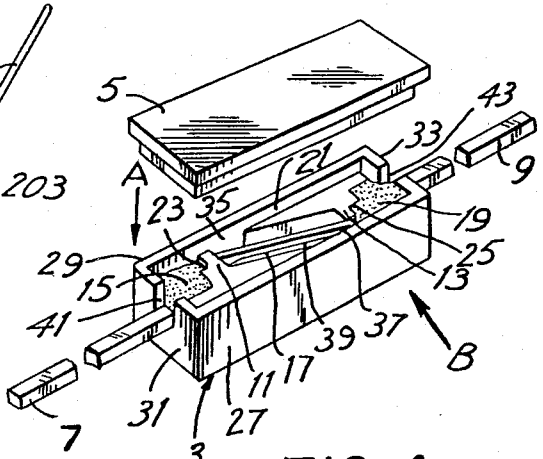
FIG. 4 is a perspective view of a micro-fuse made in accordance with the present invention, with the fuse lid removed to illustrate the interior structural details of the component parts of the fuse.

Referring back to the fuse of the present invention as shown in FIGS. 4, 5 and 6, the interior of the body or casing 3 is divided into five sections which are integral with the body 3. Thus, there is shown in FIG. 4 two raised ridges or plateaus 11 and 13 and three recesed sections 15, 17 and 19. Each of the plateaus 11 and 13 rises from an opposite wall, terminating at a length slightly below the upper edge 21 of the fuse body 3. The plateaus 11 and 13 have substantially the same configuration and size, extending from the end in the stepped portion 23 and 25 toward the center with gradual curvature. Thus, the plateaus 11 and 3 are opposed and spaced apart in face-to-face relationship with the recessed section 17 defined therebetween. Each of the recessed sections 15 and 19 is located at the end of the fuse body 3 and has a unique shape defined by the stepped portion portions 23 and 25 of the plateaus 11 and 13, the sidewalls 27, 29 and end walls 31, 33 of the fuse body 3. The recessed sections 15, 17 and 19 are connected to each other by the channels 35 and 37.

Stretched between the channels 35 and 37 and across the central recess 17 is a fusible element 39 which may be made of a variety of well known electrically conductive materials of the types known in the art. The lead wires 7 and 9 extend through the grooves 41 and 43 respectively at the ends of the fuse body 3. The grooves 41 and 43 are formed at the ends of the body 3, each extending into the recessed sections 15 and 17 and have unique configurations as shown in FIGS. 4 and 5. Solder, in pellet form, is placed in the recess sections 15 and 19, said solder is heated to melt in order to solder the fusible element 39 to the lead wires 7 and 9.

The channels 35 and 37 serve several purposes. Thus, they serve to secure the fusible element 39 at a fixed position so as not to contact the inside wall of the plateaus. Additionally, they serve to maintain a constant quantity of solder. Accordingly, the length of the fusible element remains fixed and invariable and, therefore, the fuse will display invariable thermal capacity and improved fusing characteristics.

A micro-fuse made in accordance with this invention obviates some of the disadvantages which are inherent in the conventional micro-fuses. Thus, the positioning of the fusible element and soldering it to the lead wires are carried out in an open fuse body before it is covered with a lid. Therefore, the micro-fuse of the present invention can be assembled more quickly and readily than the conventional method of assembling micro-fuses.

Another advantage is that the ends of the lead wires are preformed in cranked form to conformally fit the cranked portions 23 and 25 and then soldered to the fusible element. Consequently, the lead wires can retain greater mechanical strength against tension as compared with lead wires of conventional micro-fuses.

As it was previously mentioned, the simplicity of the method of this invention also permits higher production rates and lower manufacturing costs than conventional micro-fuses.

While the micro-fuse of the present invention has been described and illustrated with certain degrees of particularity, it must be understood that several obvious changes and modifications may be made in the construction of these fuses or in the method of their manufacture. Such changes and modifications are nevertheless within the scope of this invention.

What is claimed is:

1. An electric micro-fuse comprising a hollow body defined by a base, opposed sidewalls upstanding from said base and opposed end walls upstanding from said base; a cover for sealing said body; said body having two raised sections and three recessed sections, one of said recessed sections being disposed at the middle of said body and each of the other two recessed sections being disposed at each end of said hollow body, a first channel connecting said middle recessed section to one of said end recessed section and a second channel connecting said middle recessed section to the other end recessed section; a fusible element diagonally stretched across said middle recessed section between said first and second channels; a pair of lead wires, a first lead wire extending through one of said end walls and secured to one end of said fusible element and a second lead wire extending through the other end wall and secured to the other end of said fusible element.

2. A fuse as in claim 1 wherein each of said raised sections terminates in stepped portions and each end of said lead wires is fitted into stepped portion of said raised section.

3. A fuse as in claim 1 wherein said two end recessed sections contain solder means for securing the ends of said fusible element to the respective lead wire.

4. A fuse as in claim 2 wherein said two end recessed sections contain solder means for securing the ends of said fusible elements to the respective lead wires.

5. A fuse as in claim 1 wherein said fuse body and cover are made of heat-resistant, insulating material.

6. A fuse as in claim 2 wherein said fuse body and cover are made of heat-resistant, insulating material.

7. A fuse as in claim 3 wherein said fuse body and cover are made of heat-resistant, insulating material.

8. A fuse as in claim 4 wherein said fuse body and cover are made of heat-resistant, insulating material.

* * * * *